US009522409B2

(12) United States Patent
Hogan et al.

(10) Patent No.: US 9,522,409 B2
(45) Date of Patent: Dec. 20, 2016

(54) AEROSOL GENERATORS

(71) Applicant: Stamford Devices Limited, Danagan, Galway (IE)

(72) Inventors: Brendan Hogan, Gort (IE); Daniela Butan, Limerick (IE); Seamus Clifford, Nenagh (IE); Michael Pomeroy, Castletroy (IE); Mark Southern, Limerick (IE); David Sheil, Rahoon (IE)

(73) Assignee: Stamford Devices Limited, Galway (IE)

( * ) Notice: Subject to any disclaimer, the term of this patent is extended or adjusted under 35 U.S.C. 154(b) by 647 days.

(21) Appl. No.: 13/720,759

(22) Filed: Dec. 19, 2012

(65) Prior Publication Data

US 2013/0186975 A1 Jul. 25, 2013

Related U.S. Application Data

(60) Provisional application No. 61/578,645, filed on Dec. 21, 2011.

(51) Int. Cl.
*B05B 17/00* (2006.01)
*B05B 17/06* (2006.01)

(52) U.S. Cl.
CPC ..... *B05B 17/06* (2013.01); *B05B 17/0646* (2013.01); *B05B 17/0653* (2013.01); *B05B 17/0669* (2013.01)

(58) Field of Classification Search
CPC ..... B05B 17/06
USPC ..... 239/102.1, 548
See application file for complete search history.

(56) References Cited

U.S. PATENT DOCUMENTS 4,628,165 A * 12/1986 Nobel ..... C25D 3/567 200/268
5,164,740 A 11/1992 Ivri
5,586,550 A 12/1996 Ivri et al.
5,685,491 A * 11/1997 Marks ..... F02M 61/1853 205/70
5,758,637 A 6/1998 Ivri et al.
(Continued)

FOREIGN PATENT DOCUMENTS

WO WO-2009042187 A1 4/2009

OTHER PUBLICATIONS

Bower, Applied Mechanics of Solids, CRC Press, p. 694 (2010).
(Continued)

*Primary Examiner* — Arthur O Hall
*Assistant Examiner* — Viet Le
(74) *Attorney, Agent, or Firm* — Bookoff McAndrews, PLLC

(57) ABSTRACT

An aperture plate is formed from a palladium nickel alloy comprising about 89% palladium and about 11% nickel. There is a generally fine substantially equiaxed grain microstructure throughout the thickness of the aperture plate. The average grain width (W) is in the range of from 0.2 μm to 5.0 μm, in some cases from 0.2 μm to 2.0 μm. Because the grain structure is equiaxed (L/W=1) the grain length (L) is the same as the grain width. The improved aperture plate extends the life of nebulizers, eliminates the risk of premature and unpredictable failure of a nebulizer in service, eliminates the risk of product returns from hospitals and patients, and eliminates the possible risk of fragments of the aperture plate breaking free from the nebulizer.

11 Claims, 15 Drawing Sheets

(56) References Cited

U.S. PATENT DOCUMENTS

| | | | | |
|---|---|---|---|---|
| 6,235,177 | B1 | 5/2001 | Borland et al. | |
| 7,066,398 | B2 | 6/2006 | Borland et al. | |
| 2007/0023547 | A1 | 2/2007 | Borland et al. | |
| 2008/0108122 | A1* | 5/2008 | Paul | B01F 5/0475 435/183 |

OTHER PUBLICATIONS

Callister, Materials Science and Engineering—An Introduction, John Wiley and Sons, pp. 227-245 (2007).
DeGarmo, Materials and Processes in Manufacturing, McMillan Publishing Co., Inc., New York, 5th Edition, pp. 16, 988-989 (1979).
International Search Report for PCT/EP2012/076135, mailed Apr. 16, 2013 (4 pages).
Lu, et al., Grain Refinement in the Solidification of Undercooled Ni-Pd Alloys, Journal of Crystal Growth, 309:103-111 (2007).
Written Opinion for PCT/EP2012/076135, mailed Apr. 16, 2013 (7 pages).
International Preliminary Report and Written Opinion for PCT/EP2012/076135, mailed Jul. 3, 2014 (7 pages).

* cited by examiner

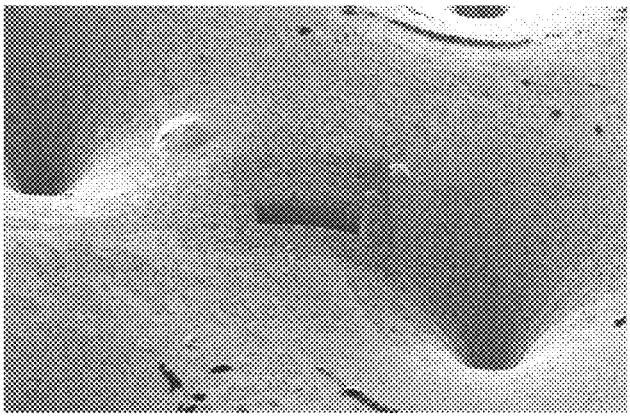
Fig. 1 (a)
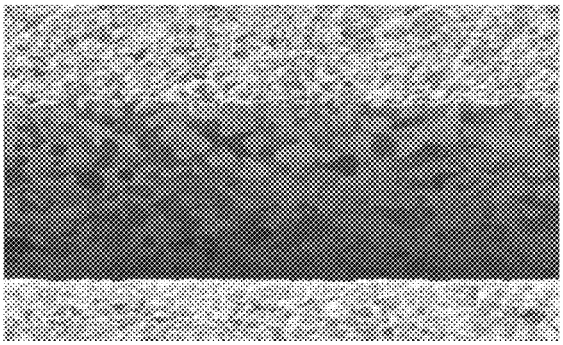
Fig. 1 (b)
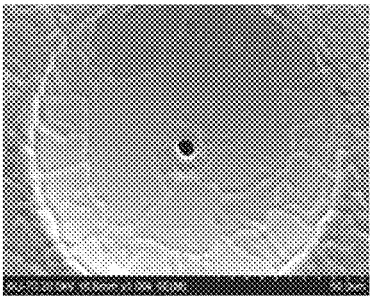
Fig. 1 (c) (i) Bottom side (120 μm in width)

Fig. 1 (c) (ii) Top side (120 um in width)

AEROSOL GENERATORS

CROSS-REFERENCE TO RELATED APPLICATIONS

This application claims the benefit of U.S. Provisional Patent Application Ser. No. 61/578,645, filed on Dec. 21, 2011, the entire content of which is incorporated herein by reference.

INTRODUCTION

This invention relates to aerosol generators.

Aerosol generators comprising a vibratable member and a plate body operably coupled to the vibratable member are known. The plate body has a top surface, a bottom surface, and a plurality of apertures extending from the top surface to the bottom surface. The apertures may be tapered such that when a liquid is supplied to one surface and the aperture plate is vibrated using the vibratable member, liquid droplets are ejected from the opposite surface. Details of such known systems are described for example in U.S. Pat. No. 6,235,177, US2007/0023547A, and US7066398, the entire contents of which are herein incorporated by reference.

The aperture plate is subjected to a dynamic cyclic stress, flexing inwards and downwards with liquid passing through the upper portion and ejected through the lower portion of the aperture plate, through the action of a member comprising a piezoelectric transducer that is configured to vibrate upon application of an electric signal as described in U.S. Pat. No. 7,066,398.

Such aperture plates are usually vibrated between 100 to 200 kHz, over extended periods of time. These periods can vary as some nebulizers are reused intermittently for up to 1 year, (which might equate to approximately 800×15 minute nebulisation periods) and others are used continuously over short periods of up to 1 week.

Callister D. W, Materials Science and Engineering—An Introduction, John Wiley and sons, 2007, p 227-245 describes fatigue as a form of failure that occurs in systems undergoing dynamic and fluctuating stresses. The term 'fatigue' is used because this type of failure normally occurs after a lengthy period of repeated stress or strain cycling. Under these circumstances it is possible for failure to occur at a stress level considerably lower than the yield strength of the material $\sigma_{TS}$ and generally below the yield strength of the material $\sigma_Y$.

The combination of high frequencies and such demanding usage periods place enormous stresses on the aperture plate. It is therefore not uncommon that the aperture plate can fail. This problem manifests itself with fractures forming on the aperture plate surface causing the nebulizer to stop functioning and rendering it impossible to deliver aerosolised medication to the patient.

Various attempts have been made to address this but the problem still persists.

One attempt has been to provide an aperture plate of a non metallic material such as a flexible polymeric material but such materials generally do not possess the stiffness required to provide the vibrational amplitude to aerosolise liquids effectively. Other attempts have been to make the nebulizer head forming the vibrating aperture plate as a disposable part of the nebulizer which can be replaced on a frequent basis. However, this presents many economic challenges.

STATEMENTS OF INVENTION

According to the invention there is provided an aperture plate body having a plurality of apertures extending between a first surface and a second surface, the plate being formed from a palladium nickel alloy comprising about 89% of palladium and about 11% nickel and having a fine randomly oriented equiaxed grain microstructure throughout the thickness of the aperture plate.

The average grain width may be from 0.2 μm to 2.0 μm, in some cases from 0.2 μm to 1.0 μm. In one embodiment the average grain width is approximately 0.5 μm.

In other cases where high temperatures (which may be in the region of 1000° C.) are used in the process to assemble the aperture plate into a nebuliser, the grain width may be up to 5 μm and may even be as high as 8 μm. One typical process which requires such high temperatures is brazing. Thus, the average grain width may be from 0.2 μm to 8.0 μm, in some cases from 0.2 μm to 5.0 μm. In some embodiments the average grain width may be from 1.0 μm to 4.0 μm The aperture plate may be of any suitable thickness. In one case the aperture plate has a thickness of from 59 to 63 microns.

The aperture plate may have a domed-shaped geometry and the aerosol exits on the convex side of the dome-shaped plate.

The invention also provides an aerosol generator comprising an aperture plate of the invention and means for vibrating the aperture plate.

The means for vibrating the aperture plate is preferably configured to vibrate the plate at a frequency of from 125 to 155 kHz. The plate may be vibrated at from 128 to 148 kHz.

The invention provides an aperture plate in which fatigue life is preserved and extended to ensure aersolisation over extended periods.

In one case the aperture plate comprises a plate body having a top surface, a bottom surface, and a plurality of apertures that taper in a direction from the top surface to the bottom surface. Liquid is supplied to the top (rear) surface of the aperture plate, and the aperture plate is vibrated to eject liquid droplets from the bottom (front) surface. Further, the apertures have an exit angle that is in the range from about 30° to about 60°, more preferably about 41° to about 49°, and more preferably at about 45°. The apertures also have a diameter that is in the range from about 1 micron to about 10 microns at the narrowest portion of the taper. Such an aperture plate is advantageous in that it may produce liquid droplets having a size that are in the range from about 2 μm to about 10 μm, at a rate in the range from about 2 μl to about 25 μl per 1000 apertures per second. In this way, the aperture plate may be employed to aerosolise a sufficient amount of a liquid medicament so that a capture chamber that may otherwise be employed to capture the aerosolised medicament will not be needed.

The aperture plate body is constructed from a palladium nickel alloy. Such an alloy is corrosion resistant to many corrosive materials particularly solutions for treating respiratory diseases by inhalation therapy, such as an albuterol sulfate and ipratropium solution, which is used in many medical applications. Further, the palladium nickel alloy has a low modulus of elasticity and therefore a lower stress for a given oscillation amplitude.

Also described is a method for aerosolizing a liquid. According to the method, an aperture plate is provided that comprises a plate body having a top surface, a bottom surface, and a plurality of apertures that taper in a direction from the top surface to the bottom surface. The apertures have an exit angle that is in the range from about 30° to about 60°, preferably in the range from about 41° to about 49°, more preferably at about 45°. The apertures also have a diameter that is in the range from about 1 micron to about 10 microns at the narrowest portion of the taper. A liquid is supplied to the top (rear) surface of the aperture plate, and the aperture plate is vibrated to eject liquid droplets from the bottom (front) surface.

Typically, the droplets have a size in the range from about 2 μm to about 10 μm. Conveniently, the aperture plate may be provided with as many apertures as possible, typically at least about 1,000 apertures so that a volume of liquid in the range from about 2 μl to about 25 μl may be produced within a time of less than about one second. In this way, a sufficient dosage may be aerosolized so that a patient may inhale the aerosolized medicament without the need for a capture chamber to capture and hold the prescribed amount of medicament.

In one particular case, the liquid that is supplied to the top surface is held to the top surface by surface tension forces until the liquid droplets are ejected from the bottom surface.

BRIEF DESCRIPTION OF THE DRAWINGS

The invention will be more clearly understood from the following description of an embodiment thereof, given by way of example only, with reference to the accompanying drawings, in which:

FIG. 1(*a*) is a micrograph of an aperture plate according to the invention with a fracture free, fine equiaxed microstructure (with a trench milled out);

FIG. 1(*b*) is a micrograph taken from the milled out trench showing a fracture free, fine equiaxed microstructure;

FIG. 1(*c*) is a micrograph of an aperture plate according to the invention showing a microstructure which is somewhat larger than that of FIGS. 1*a* and 1*b*, and caused by higher temperatures used in the process to assemble the aperture plate into a functioning nebuliser;

DETAILED DESCRIPTION

Figure 2:
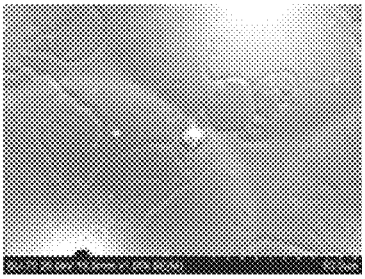
FIG. 2 is an FEA model of a vibrating aperture plate of the invention.
Figure 2:
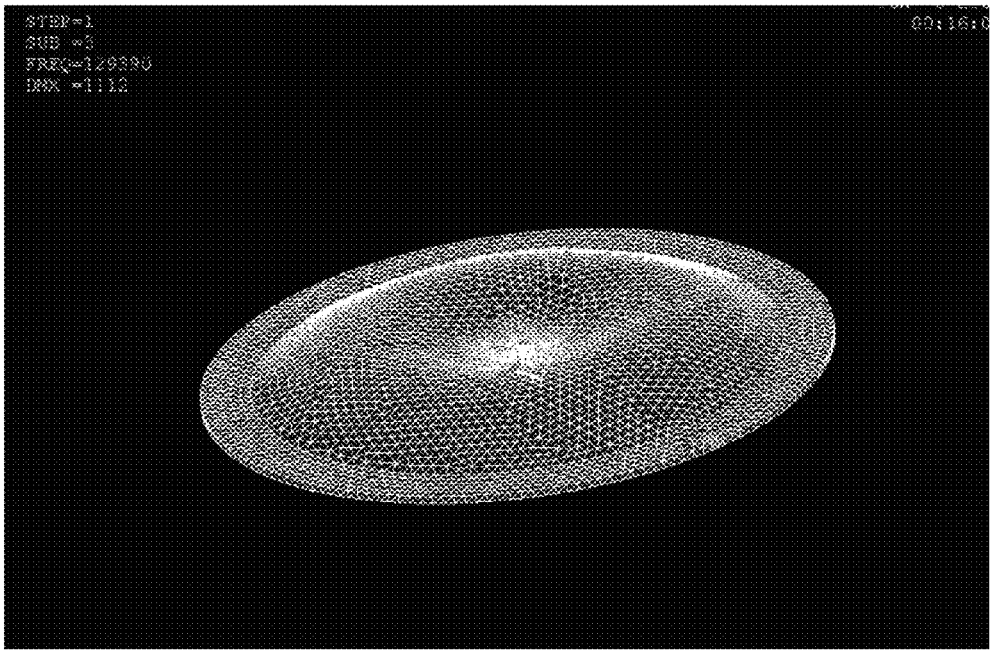

In the invention, an aperture plate is formed from a palladium nickel alloy comprising about 89% palladium and about 11% nickel. As illustrated in FIG. 1 there is a generally fine substantially equiaxed grain microstructure throughout the thickness of the aperture plate. The average grain width (W) is in the range of from 0.2 μm to 2.0 μm, in some cases from 0.2 μm to 1.0 μm. For optimum results the average grain width is approximately 0.5 μm. However grain widths up to 5 μm and possibly up to 8 μm will also provide sufficient fracture resistance.

Because the grain structure is equiaxed (L/W=1) the grain length (L) is the same as the grain width.

The grain width was obtained from SEM (Scanning Electron Microscope) pictures using the line intercept method for calculating the average grain size:

$$\overline{D} = 1.56 * \frac{C}{M * N}$$

where:

$\overline{D}$ is the average grain size,

C is the total length of the test line used,

N is the number of grain boundary intercepts on the line,

M is magnification of the micrograph

The grain structure was investigated with a Focused Ion Beam Microscope (FIB) and a FIB FEI 200 machine. Using a gallium source ($Ga^+$), with a primary ion beam of +30 keV, a trench was milled 10 μm in width×20 μm length×6 μm depth. The sample was then tilted at 45° and imaged at a magnification of 20,000× and the grain size, shape, and distribution observed.

The aperture plate also has a generally equiaxed, randomly oriented grain microstructure with an average grain width approximately 0.5 μm in size—FIG. 1, through the whole thickness of the aperture plate. The plate has a metallurgical configuration that is highly resistant to fatigue crack initiation and crack propagation.

For aperture plates that require higher processing temperatures (possibly in the region of 1000° C.) in the assembly process to incorporate the aperture plate into a nebuliser, the Focused Ion Beam Microscope (FIB) was unsuitable as the average grain size was much larger that for those aperture plates that did not experience such high temperatures in the assembly process. A more suitable technique for the estimation of grain size is the used of Surface Scanning Electron Microscopy. FIG. 1 (*c*) (i) shows a micrograph of the bottom surface and FIG. 1 (*c*) (ii) shows a micrograph of the top surface. The lines that are visible on the surface show the grain boundaries. The scale bar shows 50 μm, which is a measure of the magnification used.

In conjunction with the microstructure, in the invention the total number of vibrational cycles and the aperture plate geometrical characteristics are optimised to ensure a fracture free vibrating plate and a prolonged fatigue life for the nebuliser.

We have found that the natural frequency (NF) of the aperture plate plays an important role in determining the fatigue life of the aperture plate. The statistical analysis was successful with a 'p square' value of 0.025 and we have shown that lowering the vibrational frequency response of the aperture plate (NF) prolongs the fatigue life of the nebuliser.

During a life test, an aperture plate undergoes an approximately 810 nebulisation periods with each nebulisation period of 15 minutes duration. For example, for a vibrational frequency of 142 kHz, the total number of the aperture plate's vibrational cycles per life of a nebuliser is:

142,000 cycles/second*15*60 seconds*810≈$1.04*10^{11}$ cycles

Thus, the total number of vibrational cycles over the life time of a nebuliser is very high and this places considerable stress on the aperture plate.

It was determined that by reducing the vibrational frequency from 142 kHz to 133 kHz (a decrease of only 9 kHz), a decrease of $7*10^9$ vibrational cycle will takes place:—

133,000 cycles/second*15*60 seconds*810≈$9.7*10^{10}$ cycles 142 kHz−133 kHz=9 kHz=$1.04*10^{11}$ cycles−$9.7*10^{10}$ cycles=$7*10^9$ cycles It is known from Literature that the circular plates have characteristic sets of vibration modes. Bower [Bower A., Applied Mechanics of Solids, CRC Press, 2010, p 694], when analysing the vibrational modes and natural frequencies of a circular membrane, showed that the natural frequencies of vibrations are given by the solutions to the equation:

$$J_n\left(\omega_{(m,n)}R\sqrt{\frac{\rho h}{T_0}}\right)=0$$

where:
$J_n$ is the Bessel function,
$\omega_{(m,n)}$ is the natural frequency,
R—is the radius of the membrane,
h is the thickness of the membrane,
ρ is the mass density,
$T_0$ is the radial force per unit length.

From this equation the natural frequencies of the vibrating plate can be determined. For example, the first natural frequency denoted $\omega_{(0,1)}$ will have the formula:

$$\omega(0,1)=2.4048\sqrt{\frac{\rho h}{R^2T_0}}$$

Thus, the natural frequency is dependent on the vibrational plate's geometrical characteristics, ie thickness and plate radius (or diameter).

A FEA (Finite Element Analysis) modal analysis was conducted to simulate the vibrating behaviour of the aperture plate of the invention and to determine and predict the influence of the main factors on the vibrational characteristic of the aperture plate-mode shape and natural frequency (NF)—FIG. 2.

Figure 3:
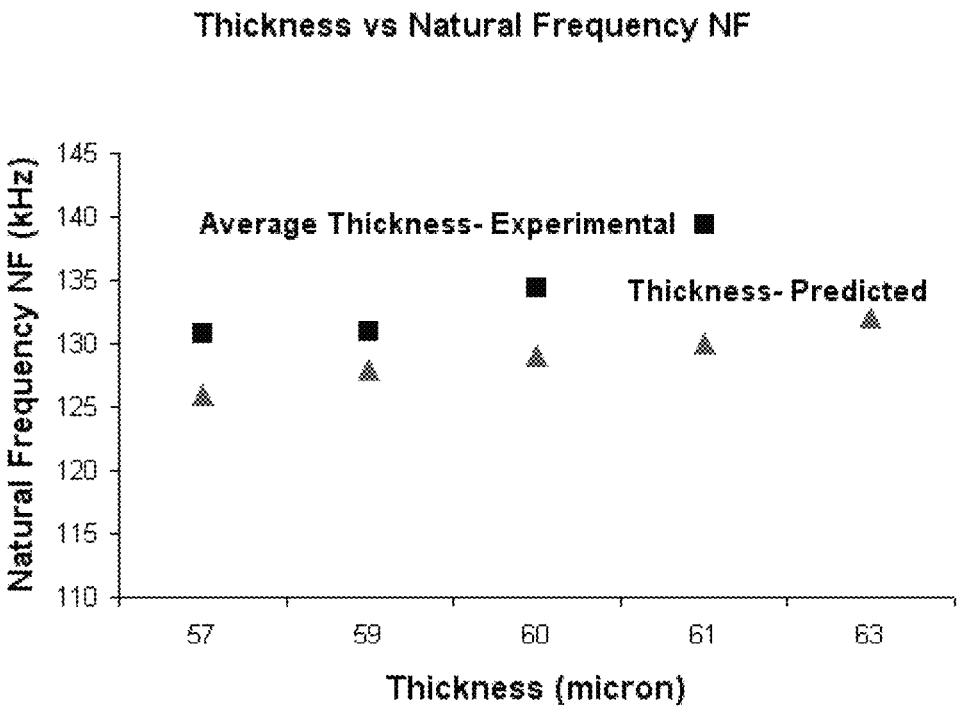
FIG. 3 illustrates a direct relationship between the thickness of the plate and natural frequency.
Figure 4:
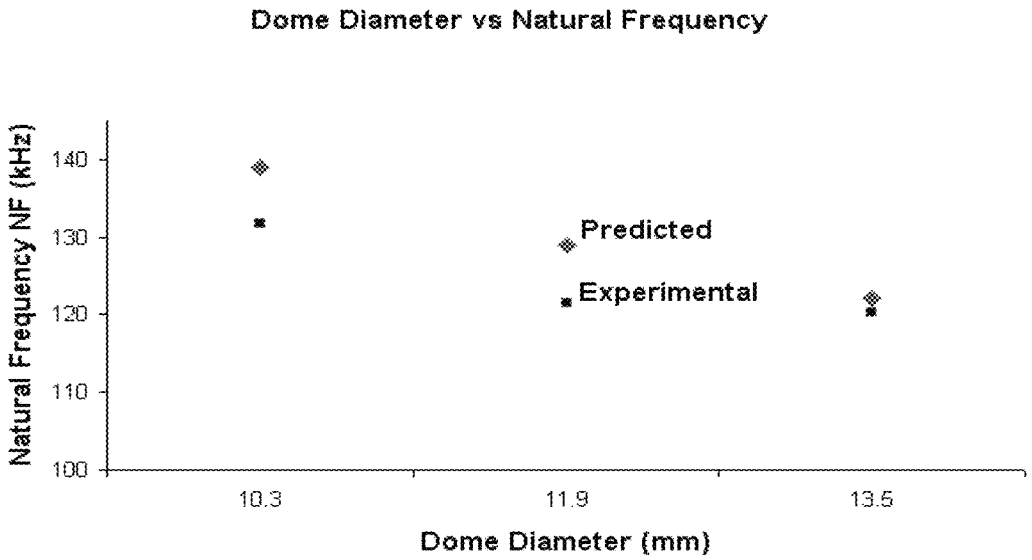
FIG. 4 illustrates an inverse relationship between the dome diameter of the plate and natural frequency.
Figure 6:
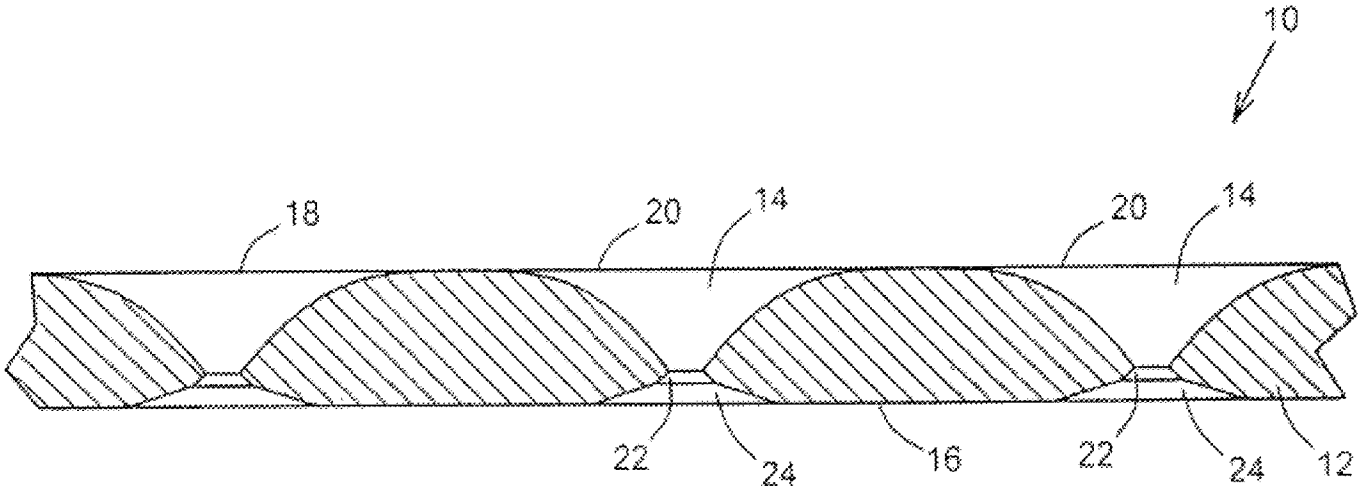
FIG. 6 is a cross-sectional side view of a portion of the aperture plate of FIG. 5.

Our simulation results showed that there is a direct relationship between the thickness of the plate and the natural vibrational frequency (NF)—FIG. 3, and an inverse relationship between the plate dome diameter and the natural vibrational frequency (NF)—FIG. 6 and this correlates with our experimental findings.

In order to lower the vibrational response (NF) of the plate, the thickness of the aperture plate can be reduced or the dome diameter can be increased.

For example, decreasing the plate thickness by 3 μm will decrease the natural frequency up to 9 kHz and that will contribute to an increase in the fatigue life of the vibrational plate as described above.

In the invention we provide an aperture plate with a generally equiaxed microstructure. The fatigue life may be further enhanced using a lower specification of the thickness and natural frequency range.

An increase in the fatigue life of the vibrating aperture plate, provides suitable aersolisation over extended periods of time.

The invention provides an improved aperture plate that:—
- extends the life of nebulisers;
- eliminates the risk of premature and unpredictable failure of a nebuliser in service;
- eliminates the risk of product returns from hospitals and patients; and
- eliminates the possible risk of fragments of the aperture plate breaking free from the nebulizer.

Vibrating mesh nebulisers are in common use today for the treatment of a range of respiratory ailments which require the aersolisation of medication to the lungs.

As described in US20070023547A the aperture plates of the invention are constructed of a relatively thin plate that may be formed into a desired shape and includes a plurality of apertures that are employed to produce fine liquid droplets when the aperture plate is vibrated. Techniques for vibrating such aperture plates are described generally in U.S. Pat. Nos. 5,164,740; 5,586,550; and 5,758,637, which are incorporated herein by reference. The aperture plates are constructed to permit the production of relatively small liquid droplets at a relatively fast rate. For example, the aperture plates of the invention may be employed to produce liquid droplets having a size in the range from about 2 microns to about 10 microns, and more typically between about 2 microns to about 5 microns. In some cases, the aperture plates may be employed to produce a spray that is useful in pulmonary drug delivery procedures. As such, the sprays produced by the aperture plates may have a respirable fraction that is greater than about 70%, preferably more than about 80%, and most preferably more than about 90% as described in U.S. Pat. No. 5,758,637.

In some embodiments, such fine liquid droplets may be produced at a rate in the range from about 2 microliters per second to about 25 microliters per second per 1000 apertures. In this way, aperture plates may be constructed to have multiple apertures that are sufficient to produce aerosolized volumes that are in the range from about 2 microliters to about 25 microliters, within a time that is less than about one second. Such a rate of production is particularly useful for pulmonary drug delivery applications where a desired dosage is aerosolized at a rate sufficient to permit the aerosolised medicament to be directly inhaled. In this way, a capture chamber is not needed to capture the liquid droplets until the specified dosage has been produced. In this manner, the aperture plates may be included within aerosolisers, nebulizers, or inhalers that do not utilise elaborate capture chambers.

The aperture plate may be employed to deliver a wide variety of drugs to the respiratory system. For example, the aperture plate may be utilized to deliver drugs having potent therapeutic agents, such as hormones, peptides, and other drugs requiring precise dosing including drugs for local treatment of the respiratory system. Examples of liquid drugs that may be aerosolized include drugs in solution form, e.g., aqueous solutions, ethanol solutions, aqueous/ethanol mixture solutions, and the like, in colloidal suspension form, and the like. The invention may also find use in aerosolizing a variety of other types of liquids, such as insulin.

The palladium nickel alloy aperture plates of the invention may be used with a variety of liquids without significantly corroding the aperture plate. Examples of liquids that may be used and which will not significantly corrode such an aperture plate include albuterol, chromatin, and other inhalation solutions that are normally delivered by jet nebulizers, and the like.

The palladium nickel alloy has a low modulus of elasticity. The stress for a given oscillation amplitude is proportional to the amount of elongation and the modulus of elasticity. By providing the aperture plate with a lower modulus of elasticity, the stress on the aperture plate is significantly reduced.

To enhance the rate of droplet production while maintaining the droplets within a specified size range, the apertures may be constructed to have a certain shape. More specifically, the apertures are preferably tapered such that the aperture is narrower in cross section where the droplet exits the aperture. In one case, the angle of the aperture at the exit opening (or the exit angle) is in the range from about 30° to about 60°, more preferably from about 41° to about 49°, and more preferably at about 45°. Such an exit angle provides for an increased flow rate while minimizing droplet size. In this way, the aperture plate may find particular use with inhalation drug delivery applications.

The apertures of the aperture plates will typically have an exit opening having a diameter in the range from about 1 micron to about 10 microns, to produce droplets that are about 2 microns to about 10 microns in size. In another case, the taper at the exit angle is preferably within the desired angle range for at least about the first 15 microns of the aperture plate. Beyond this point, the shape of the aperture is less critical. For example, the angle of taper may increase toward the opposite surface of the aperture plate.

The aperture plates of the invention may be formed in the shape of a dome as described generally in U.S. Pat. No. 5,758,637. As described above, for optimum performance the aperture plate is vibrated at a frequency in the range from about 125 kHz to about 155 kHz when aerosolising a liquid. Further, when aerosolising a liquid, the liquid may be placed onto a rear surface of the aperture plate where the liquid adheres to the rear surface by surface tension forces. Upon vibration of the aperture plate, liquid droplets are ejected from the front surface as described generally in U.S. Pat. Nos. 5,164,740, 5,586,550 and 5,758,637.

The aperture plates of the invention may be constructed using an electro-deposition process where a metal is deposited from a solution onto a conductive mandrel by an electrolytic process. In one example, the aperture plates are formed using an electroforming process where the metal is electroplated onto an accurately made mandrel that has the inverse contour, dimensions, and surface finish desired on the finished aperture plate. When the desired thickness of deposited metal has been attained, the aperture plate is separated from the mandrel. Electroforming techniques are described generally in E. Paul DeGarmo, "Materials and Processes in Manufacturing" McMillan Publishing Co., Inc., New York, 5.sup.th Edition, 1979, the complete disclosure of which is herein incorporated by reference.

The mandrels that may be utilised to produce the aperture plates may comprise a conductive surface having a plurality of spaced apart nonconductive islands. In this way, when the mandrel is placed into the solution and current is applied to the mandrel, the metal material in the solution is deposited onto the mandrel.

A variety of other techniques may be employed to place a pattern of nonconductive material onto the electroforming mandrel. Examples of techniques that may be employed to produce the desired pattern include exposure, silk screening, and the like. This pattern is then employed to control where plating of the material initiates and continues throughout the plating process. A variety of nonconductive materials may be employed to prevent plating on the conductive surface, such as a photoresist, plastic, and the like. As previously mentioned, once the nonconducting material is placed onto the mandrel, it may optionally be treated to obtain the desired profile. Examples of treatments that may be used include baking, curing, heat cycling, carving, cutting, molding or the like. Such processes may be employed to produce a curved or angled surface on the nonconducting pattern which may then be employed to modify the angle of the exit opening in the aperture plate.

Figure 5:
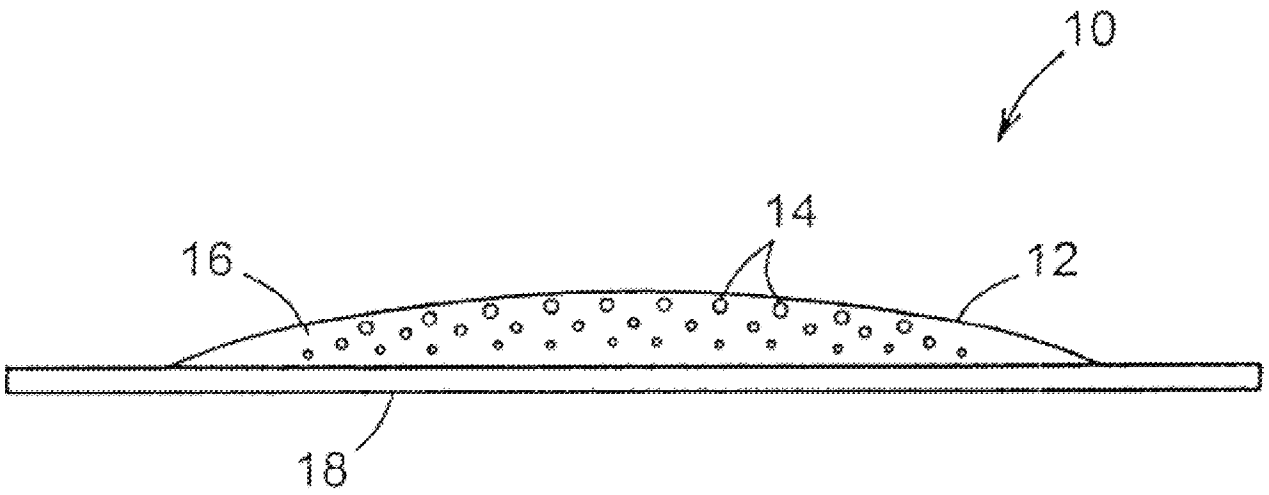
FIG. 5 is a side view of an aperture plate.

Referring now to FIG. 5, one aperture plate 10 will be described. Aperture plate 10 comprises a plate body 12 into which are formed a plurality of tapered apertures 14. Plate body 12 is constructed of a palladium nickel alloy as described above. The plate body 12 may be configured to have a dome shape as described generally in U.S. Pat. No. 5,758,637, previously incorporated by reference. Plate body 12 includes a top or front surface 16 and a bottom or rear surface 18. In operation, liquid is supplied to rear surface 18 and liquid droplets are ejected from front surface 16.

Referring to FIG. 6, the configuration of apertures 14 will be described in greater detail. Apertures 14 are configured to taper from rear surface 18 to front surface 16. Each aperture 14 has an entrance opening 20 and an exit opening 22. With this configuration, liquid supplied to rear surface 18 proceeds through entrance opening 20 and exits through exit opening 22. As shown, plate body 12 further includes a flared portion 24 adjacent exit opening 22. As described in greater detail hereinafter, flared portion 24 is created from the manufacturing process employed to produce aperture plate 10.

Figure 7:
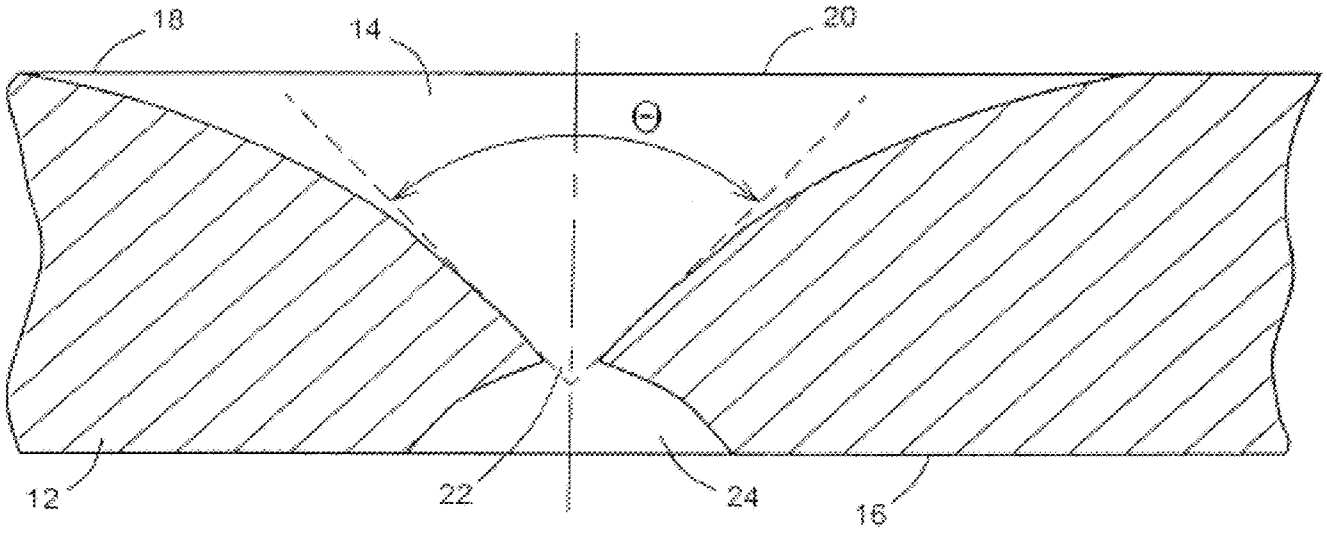
FIG. 7 is a more detailed view of one of the apertures of the aperture plate of FIG. 6.

As best shown in FIG. 7, the angle of taper of apertures 14 as they approach exit openings 22 may be defined by an exit angle θ. The exit angle is selected to maximize the ejection of liquid droplets through exit opening 20 while maintaining the droplets within a desired size range. Exit angle θ may be constructed to be in the range from about 30° to about 60° more preferably from about 41° to about 49°, and most preferably around 45°. Also, exit opening 22 may have a diameter in the range from about 1 micron to about 10 microns. Further, the exit angle θ preferably extends over a vertical distance of at least about 15 microns, i.e., exit angle θ is within the above recited ranges at any point within this vertical distance. As shown, beyond this vertical distance, apertures 14 may flare outward beyond the range of the exit angle θ.

In operation, liquid is applied to rear surface 18. Upon vibration of aperture plate 10, liquid droplets are ejected through exit opening 22. In this manner, the liquid droplets will be propelled from front surface 16. Although exit opening 22 is shown inset from front surface 16, it will be appreciated that other types of manufacturing processes may be employed to place exit opening 22 directly at front surface 16.

Figure 8:
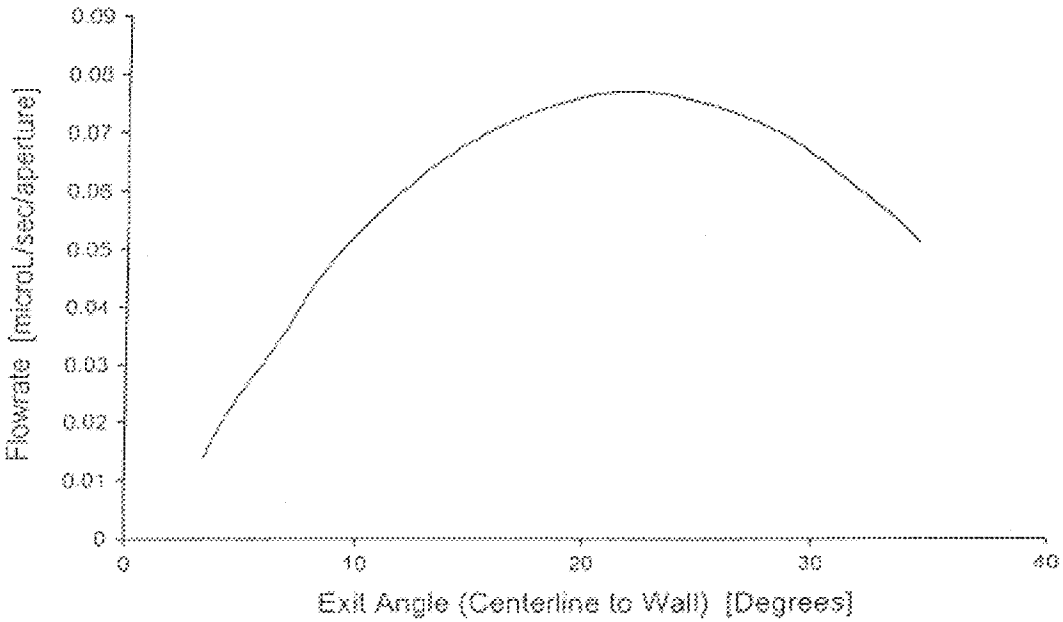
FIG. 8 is a graph illustrating the flow rate of liquid through an aperture as the exit angle of the aperture is varied.

FIG. 8 is a graph containing aerosolisation simulation data when vibrating an aperture plate similar to aperture plate 10 of FIG. 1. In the graph of FIG. 8, the aperture plate was vibrated at about 180 kHz when a volume of water was applied to the rear surface. Each aperture had an exit diameter of 5 microns. In the simulation, the exit angle was varied from about 10° to about 70°. (noting that the exit angle in FIG. 8 is from the center line to the wall of the aperture). As shown, the maximum flow rate per aperture occurred at about 45°. Relatively high flow rates were also achieved in the range from about 41° to about 49°. Exit angles in the range from about 30° to about 60° also produced high flow rates. Hence, in this example, a single aperture is capable of ejecting about 0.08 microliters of water per second when ejecting water. For many medical solutions, an aperture plate containing about 1000 apertures that each have an exit angle of about 45° may be used to produce a dosage in the range from about 30 microliters to about 50 microliters within about one second. Because of such a rapid rate of production, the aerosolized medicament may be inhaled by the patient within a few inhalation maneuvers without first being captured within a capture chamber.

Figure 9:
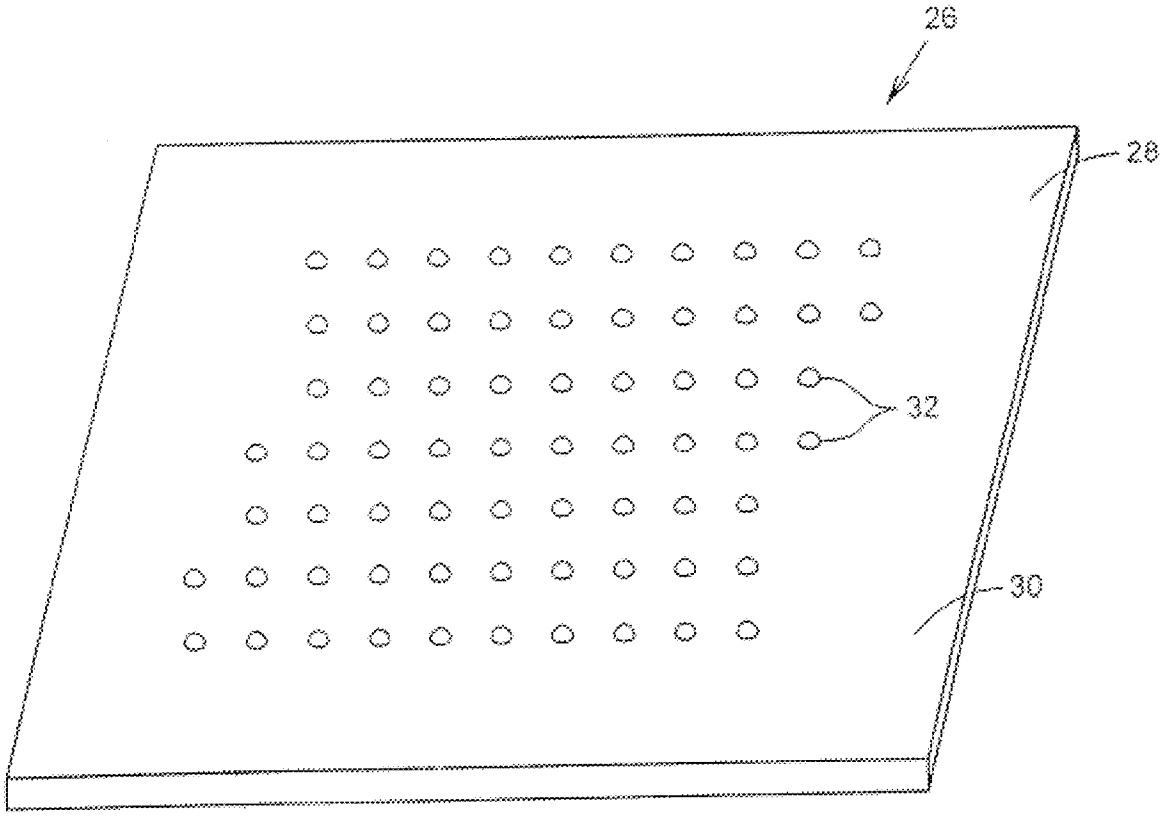
FIG. 9 is a top perspective view of a mandrel having nonconductive islands to produce an aperture plate in an electroforming process.

Apparatus and methods used for electroforming that may be used to construct the aperture plate are described in US2007/0023547A. Referring to FIG. 9, one embodiment of an electroforming mandrel 26 that may be employed to construct aperture plate 10 of FIG. 5 will be described. Mandrel 26 comprises a mandrel body 28 having a conductive surface 30. The mandrel body 28 may be constructed of a metal, such as stainless steel. As shown, conductive surface 30 is flat in geometry. However, in some cases it will be appreciated that conductive surface 30 may be shaped depending on the desired shape of the resulting aperture plate. Disposed on conductive surface 30 are a plurality of nonconductive islands 32. Islands 32 are configured to extend above conductive surface 30 so that they may be employed in electroforming apertures within the aperture plate as described in greater detail hereinafter. Islands 32 may be spaced apart by a distance corresponding to the desired spacing of the resulting apertures in the aperture plate. Similarly, the number of islands 32 may be varied depending on the particular need.

Figure 10:
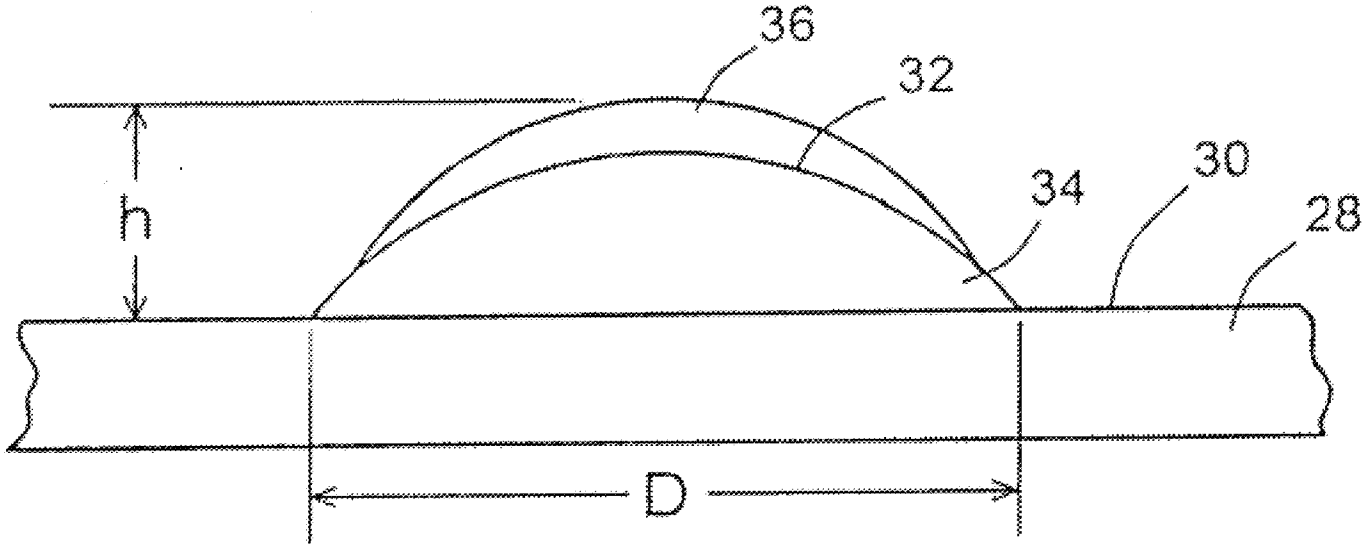
FIG. 10 is a side view of a portion of the mandrel of FIG. 9 showing one of the nonconductive islands in greater detail.

Referring now to FIG. 10, construction of islands 32 will be described in greater detail. As shown, island 32 is generally conical or dome shaped in geometry. Conveniently, island 32 may be defined in terms of a height h and a diameter D. As such, each island 32 may be said to include an average angle of incline or slope that is defined by the inverse tangent of ½(D)/h. The average angle of incline may be varied to produce the desired exit angle in the aperture plate as previously described.

As shown, island 32 is constructed of a bottom layer 34 and a top layer 36. As described in greater detail hereinafter, use of such layers assists in obtaining the desired conical or domed shape. However, it will be appreciated that islands 32 may in some cases be constructed from only a single layer or multiple layers.

Figure 11:
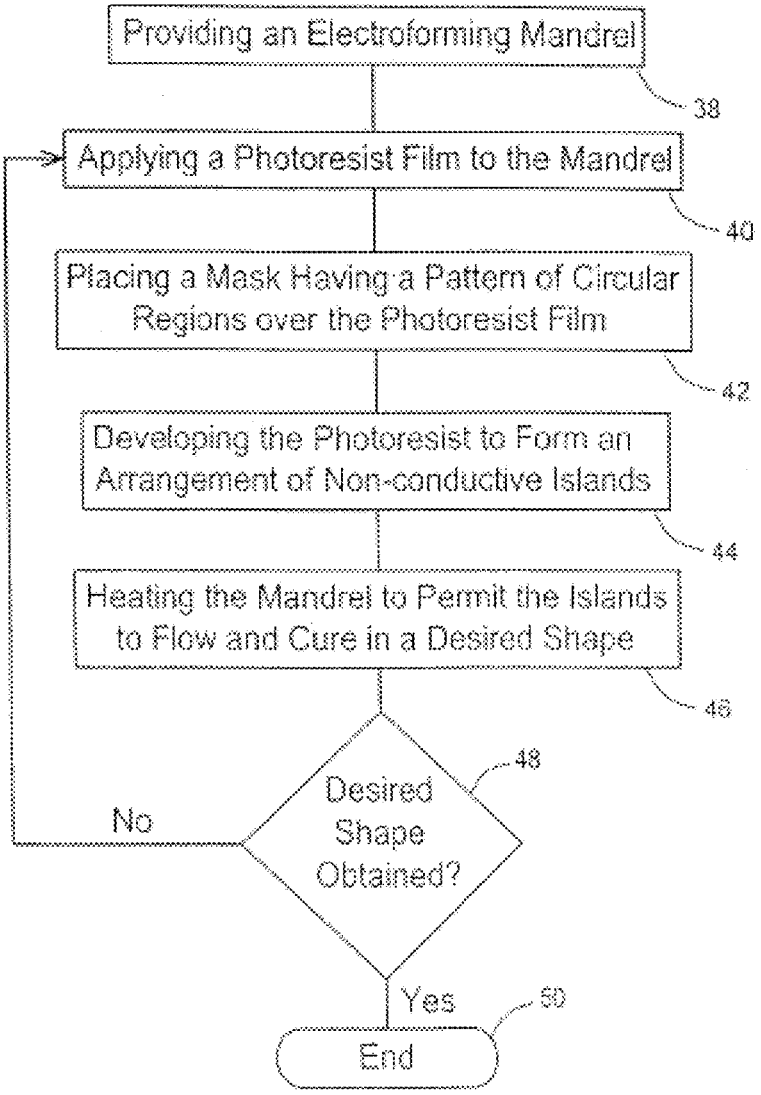
FIG. 11 is a flow chart illustrating one method for producing an electroforming mandrel.

Referring to FIG. 11, one method for forming nonconductive islands 32 on mandrel body 28 will be described. As shown in step 38, the process begins by providing an electroforming mandrel. As shown in step 40, a photoresist film is then applied to the mandrel. As one example, such a photoresist film may comprise a thick film photoresist having a thickness in the range from about 7 to about 9 microns. Such a thick film photoresist may comprise a Hoechst Celanese AZ P4620 positive photoresist. Conveniently, such a resist may be pre-baked in a convection oven in air or other environment for about 30 minutes at about 100° C. As shown in step 42, a mask having a pattern of circular regions is placed over the photoresist film. As shown in step 44, the photoresist film is then developed to form an arrangement of nonconductive islands. Conveniently, the resist may be developed in a basic developer, such as a Hoechst Celanese AZ 400 K developer. Although described in the context of a positive photoresist, it will be appreciated that a negative photoresist may also be used as is known in the art.

As shown in step 46, the islands are then treated to form the desired shape by heating the mandrel to permit the islands to flow and cure in the desired shape. The conditions of the heating cycle of step 46 may be controlled to determine the extent of flow (or doming) and the extent of curing that takes place, thereby affecting the durability and permanence of the pattern. In one case, the mandrel is slowly heated to an elevated temperature to obtain the desired amount of flow and curing. For example, the mandrel and the resist may be heated at a rate of about 2° C. per minute from room temperature to an elevated temperature of about 240° C. The mandrel and resist are then held at the elevated temperature for about 30 minutes.

In some cases, it may be desirable to add photoresist layers onto the nonconductive islands to control their slope and further enhance the shape of the islands. Hence, as shown in step 48, if the desired shape has not yet been obtained, steps 40-46 may be repeated to place additional photoresist layers onto the islands. Typically, when additional layers are added, the mask will contain circular regions that are smaller in diameter so that the added layers will be smaller in diameter to assist in producing the domed shape of the islands. As shown in step 50, once the desired shape has been attained, the process ends.

Figure 12:
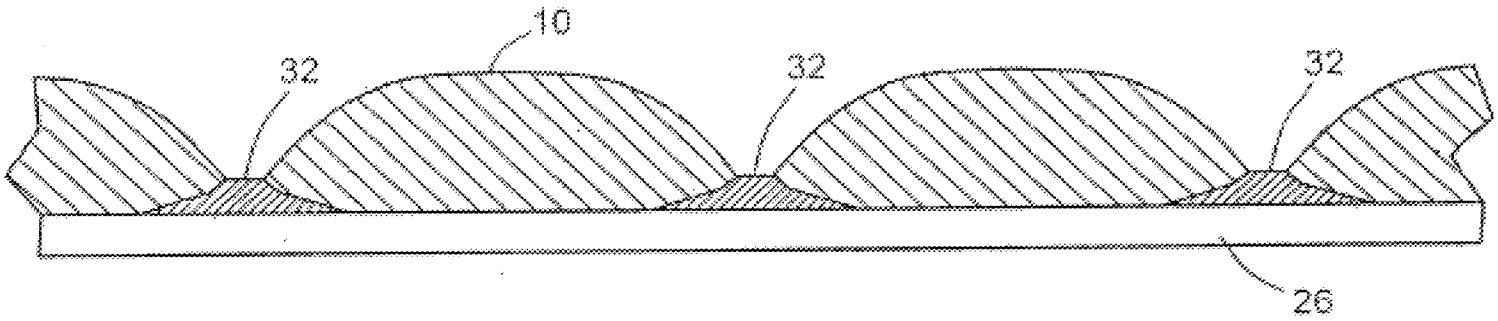
FIG. 12 is a cross-sectional side view of the mandrel of FIG. 11 when used to produce an aperture plate using an electroforming process.
Figure 13:
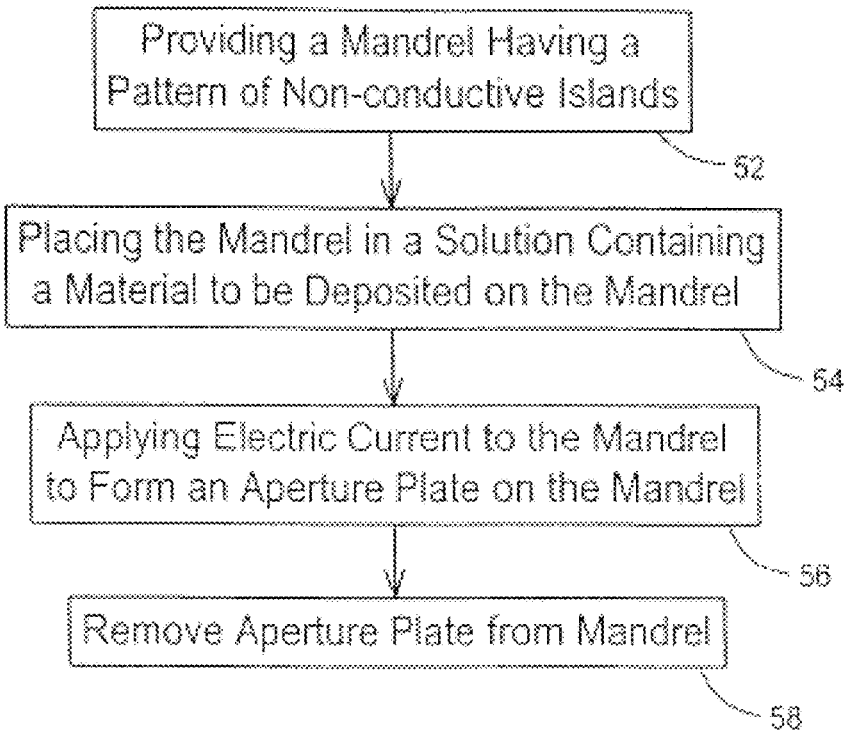
FIG. 13 is flow chart illustrating one method for producing an aperture plate.

Referring now to FIGS. 12 and 13, a process for producing aperture plate 10 will be described. As shown in step 52 of FIG. 13, a mandrel having a pattern of nonconductive islands is provided. Conveniently, such a mandrel may be mandrel 26 of FIG. 9 as illustrated in FIG. 12. The process then proceeds to step 54 where the mandrel is placed in a solution containing a material that is to be deposited on the mandrel. As one example, the solution may be a Pallatech PdNi plating solution, commercially available from Lucent Technologies, containing a palladium nickel that is to be deposited on mandrel 26. As shown in step 56, electric current is supplied to the mandrel to electro deposit the material onto mandrel 26 and to form aperture plate 10. As shown in step 56, once the aperture plate is formed, it may be peeled off from mandrel 26.

To obtain the desired exit angle and the desired exit opening on aperture plate 10, the time during which electric current is supplied to the mandrel may be varied. Further, the type of solution into which the mandrel is immersed may also be varied. Still further, the shape and angle of islands 32 may be varied to vary the exit angle of the apertures as previously described. Merely by way of example, one mandrel that may be used to produce exit angles of about 45° is made by depositing a first photoresist island having a diameter of 100 microns and a height of 10 microns. The second photoresist island may have a diameter of 10 microns and a thickness of 6 microns and is deposited on a center of the first island. The mandrel is then heated to a temperature of 200° C. for 2 hours.

Figure 14:
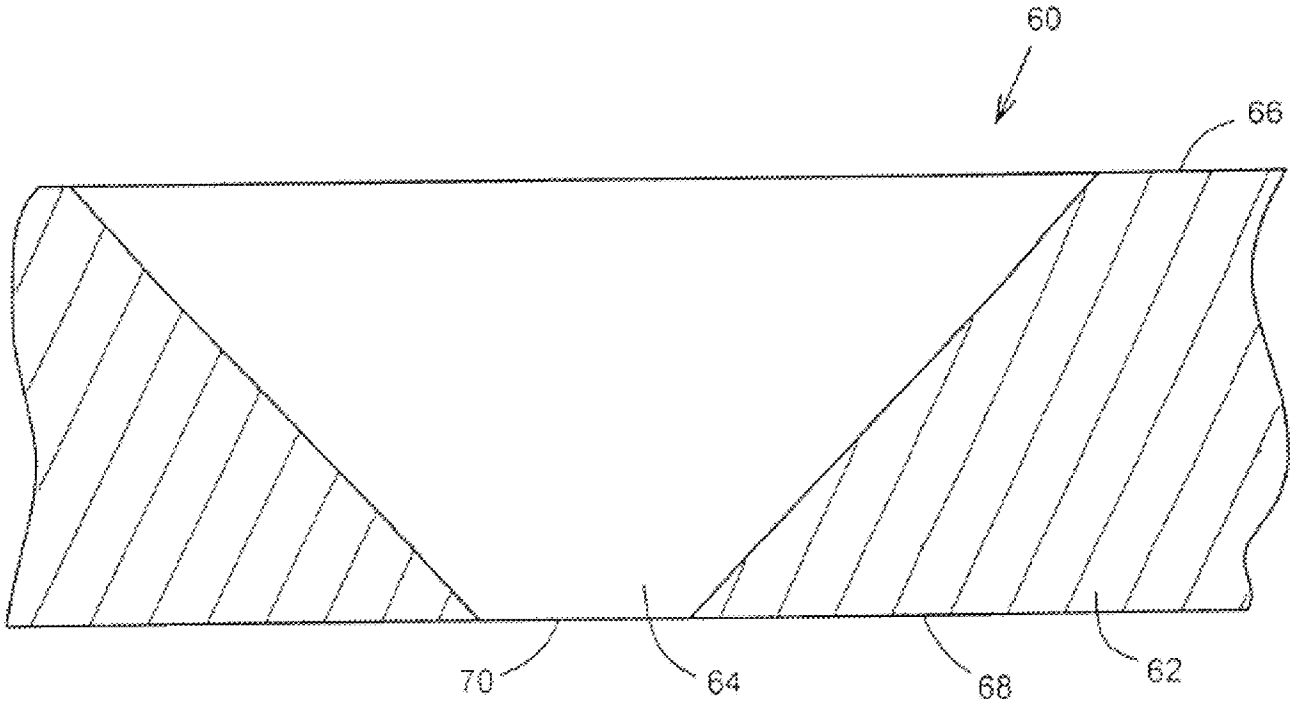
FIG. 14 is a cross-sectional side view of a portion of an alternative aperture plate.

Referring now to FIG. 14, an alternative embodiment of an aperture plate 60 will be described. Aperture plate 60 comprises a plate body 62 having a plurality of tapered apertures 64 (only one being shown for convenience of illustration). Plate body 62 has a rear surface 66 and a front surface 68. Apertures 64 are configured to taper from rear surface 66 to front surface 68. As shown, aperture 64 has a constant angle of taper. Preferably, the angle of taper is in the range from about 30° to about 60°, more preferably about 41° to about 49°, and most preferably at about 45°. Aperture 64 further includes an exit opening 70 that may have a diameter in the range from about 2 microns to about 10 microns.

Figure 15:
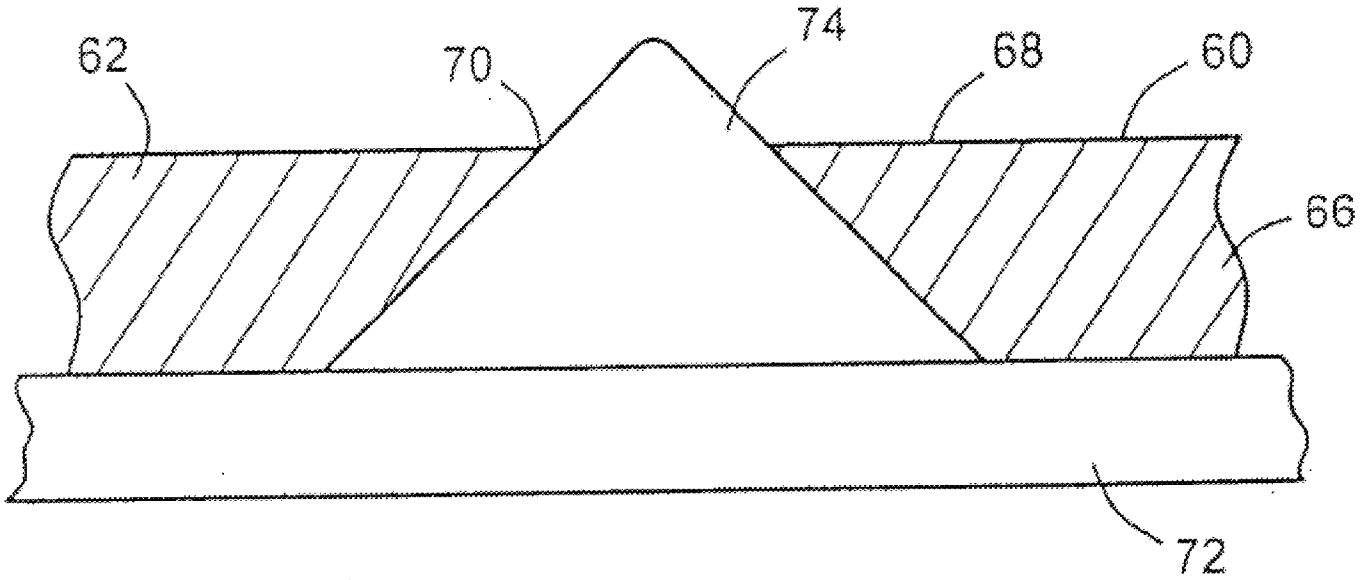
FIG. 15 is a side view of a portion of an alternative electroforming mandrel when used to form the aperture plate of FIG. 14.

Referring to FIG. 15, one method that may be employed to construct aperture plate 62 will be described. The process employs the use of an electroforming mandrel 72 having a plurality of non-conductive islands 74. Conveniently, island 74 may be constructed to be generally conical or domed-shaped in geometry and may be constructed using any of the processes previously described herein. To form aperture plate 60, mandrel 72 is placed within a solution and electrical current is applied to mandrel 72. The electroplating time is controlled so that front surface 68 of aperture plate 60 does not extend above the top of island 74. The amount of electroplating time may be controlled to control the height of aperture plate 60. As such, the size of exit openings 72 may be controlled by varying the electroplating time. Once the desired height of aperture plate 60 is obtained, electrical current is ceased and mandrel 72 may be removed from aperture plate 60.

Figure 16:
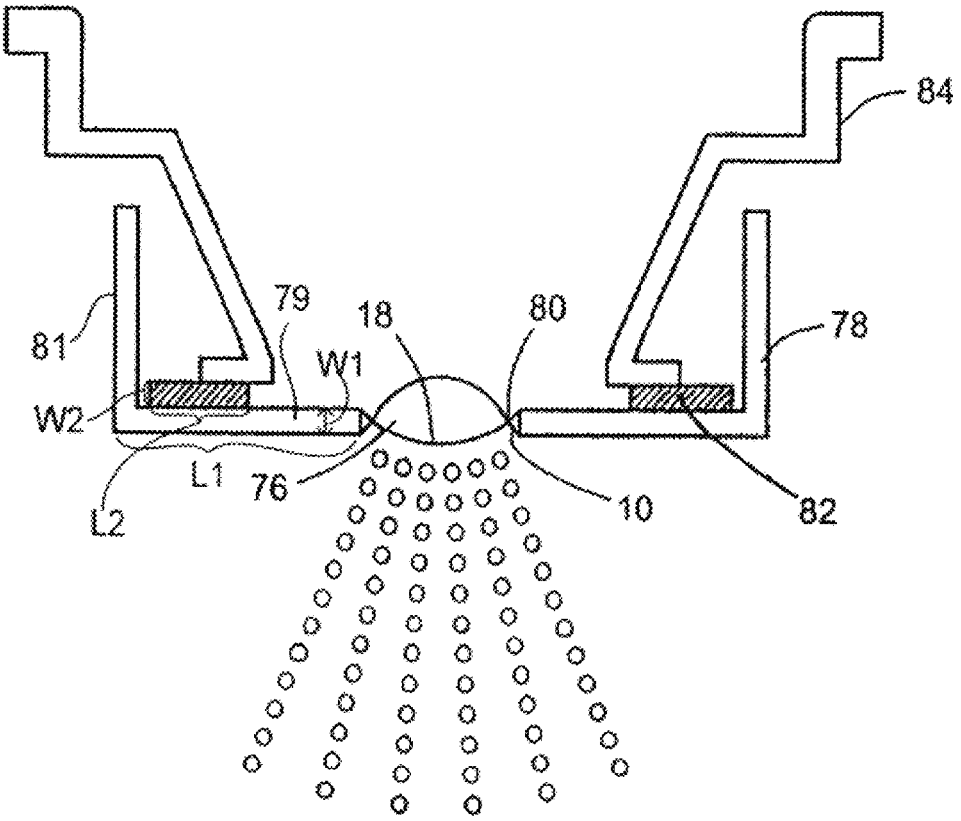
FIG. 16 illustrates the aperture plate of FIG. 5 when used in an aerosol generator to aerosolize a liquid.

Referring now to FIG. 16, use of aperture plate 10 to aerosolise a volume of liquid 76 will be described. Conveniently, aperture plate 10 is coupled to a cupped shaped member 78 having a central opening 80. Aperture plate 10 is placed over opening 80, with rear surface 18 being adjacent liquid 76. A piezoelectric transducer 82 is coupled to cupped shaped member 78. An interface 84 may also be provided as a convenient way to couple the aerosol generator to other components of a device. In operation, electrical current is applied to transducer 82 to vibrate aperture plate 10. Liquid 76 may be held to rear surface 18 of aperture plate 10 by surface tension forces. As aperture plate 10 is vibrated, liquid droplets are ejected from the front surface as shown.

As previously mentioned, aperture plate 10 may be constructed so that a volume of liquid in the range from about 4 microliters to about 30 microliters may be aerosolized within a time that is less than about one second per about 1000 apertures. Further, each of the droplets may be produced such that they have a respirable fraction that is greater than about 90 percent. In this way, a medicament may be aerosolized and then directly inhaled by a patient.

The invention is not limited to the embodiments hereinbefore described which may be varied in construction and detail.

The invention claimed is:

1. An aperture plate body having a plurality of apertures extending between a first surface and a second surface, the aperture plate body being formed from an electroformed palladium nickel alloy comprising about 89% of palladium and about 11% nickel and having a generally fine randomly oriented substantially equiaxed grain microstructure throughout the thickness of the aperture plate body, wherein an average grain width of the grain microstructure is from 0.2 μm to 2.0 μm.

2. An aperture plate body as claimed in claim 1 wherein an average grain width of the grain microstructure is from 0.2 μm to 1.0 μm.

3. An aperture plate body as claimed in claim 1 wherein an average grain width of the grain microstructure is approximately 0.5 μm.

4. An aperture plate body as claimed in claim 1 wherein the aperture plate body has a thickness of from 59 to 63 microns.

5. An aperture plate body as claimed in claim 1 which is domed-shaped in geometry.

6. An aerosol generator comprising an aperture plate body as claimed in claim 1 and a vibrator for vibrating the aperture plate body.

7. An aerosol generator as claimed in claim 6 wherein the vibrator is configured to vibrate the aperture plate body at a frequency of from 125 to 155 kHz.

8. An aperture plate body having a plurality of apertures extending between a first surface and a second surface, the aperture plate body being dome-shaped and comprising a palladium nickel alloy having a randomly oriented equiaxed grain microstructure throughout the thickness of the aperture plate body, wherein the aperture plate body includes a plurality of electroformed layers of material, wherein an average grain width of the grain microstructure is from 0.2 μm to 2.0 μm.

9. An aperture plate body as claimed in claim 8 wherein an average grain width of the grain microstructure is from 0.2 μm to 1.0 μm.

10. An aperture plate body as claimed in claim 8 wherein an average grain width of the grain microstructure is approximately 0.5 μm.

11. An aperture plate body as claimed in claim 8 wherein the aperture plate body has a thickness of from 59 to 63 microns.

* * * * *